United States Patent [19]

Starkweather

[11] 4,331,335

[45] May 25, 1982

[54] HARDWARE ELEMENTS STORAGE DISPENSER AND GAME DEVICE

[76] Inventor: Donald E. Starkweather, 7435 Madison, Kansas City, Mo. 64114

[21] Appl. No.: 104,189

[22] Filed: Dec. 17, 1979

[51] Int. Cl.[3] ..... A47F 1/08; B65D 85/24; F41J 1/00

[52] U.S. Cl. ..... 273/345; 108/32; 206/44.12; 206/350; 206/818; 211/DIG. 1; 312/35; 273/400; 335/285

[58] Field of Search ..... 273/345, 400, 401; 108/32; 206/338, 350, 818, 44.12; 211/10, 11, 126, DIG. 1; 221/212; 312/117, 118, 234.4, 35; 335/285

[56] References Cited

U.S. PATENT DOCUMENTS

| | | | |
|---|---|---|---|
| 439,646 | 11/1890 | Fogarty | 312/351 X |
| 2,128,854 | 8/1938 | Sagendorph et al. | 211/10 X |
| 2,457,421 | 12/1948 | Warren | 211/DIG. 1 UX |
| 3,121,407 | 2/1964 | Wise | 108/32 |
| 3,704,777 | 12/1972 | Linnebuhr | 221/212 X |

*Primary Examiner*—Anton O. Oechsle
*Attorney, Agent, or Firm*—Thomas M. Scofield

[57] ABSTRACT

Improvements in storage dispensers for metallic objects having magnetic properties; a storage dispenser for paper clips and the like made up of a hollow vertical hopper with a downwardly slanted floor and an opening on one side, there being magnetic retainer means on an extension of the inclined floor; honeycomb or cellular structures for storing and dispensing metallic objects having magnetic properties; inclined floor storage and dispensing constructions with magnetic retainer means; devices receiving, storing and readily making available for dispensing therefrom of metallic objects with magnetic properties; games utilizing one or more cubicles, cells or openings having inclined floors therein with magnetic retainer means adapted to receive, retain and sometimes reject metallic objects with magnetic properties.

33 Claims, 19 Drawing Figures

Fig. 4.
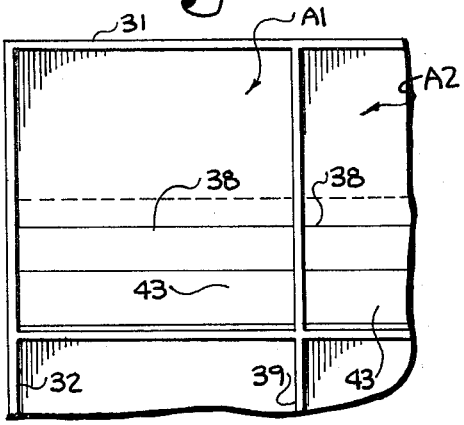
Fig. 6.
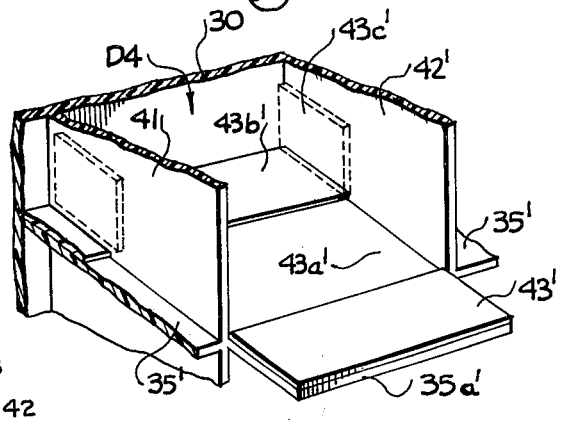
Fig. 18.
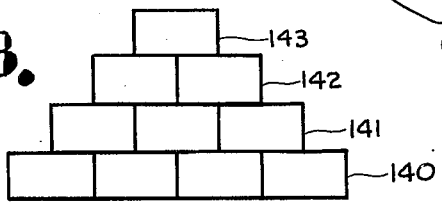
Fig. 7.
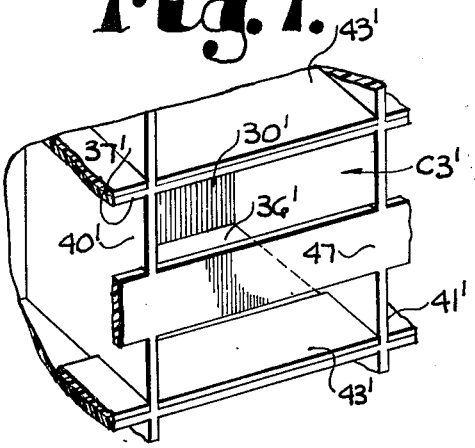
Fig. 11.
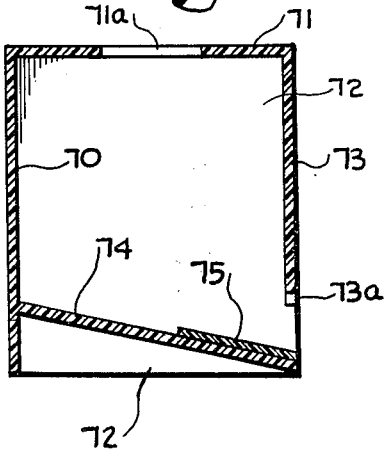
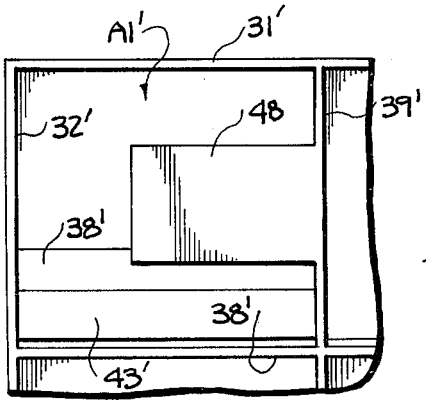
Fig. 8.

HARDWARE ELEMENTS STORAGE DISPENSER AND GAME DEVICE

BACKGROUND OF THE INVENTION

In the hardware business, it is well known to provide a multiplicity of cellular boxes or containers in an array to hold and present for dispensing metallic objects such as bolts, nuts, screws, hooks, nails, tacks and the like. These conventional containers, which commonly present like objects of differing sizes or related objects of differing configuration, are produced of varying materials in varying sizes. That is, the individual shapes of such cells in an integral structure may be rectangular, square, circular, hexagonal or other forms. Retainers may be provided across the lower portion of the normally open front faces. The walls may be metal, wood, plastic or the like. The floors of the cells may be sloped forwardly, but in such case, they commonly have front face retainers to prevent spilling.

It would be desirable to provide a completely open honeycomb construction for display and dispensing of hardware items of the type noted. In office use, additionally, thumb tacks, paper clips, brads, etc often need storing and dispensing in like manner. Thus, it would be most desirable to have entirely open face cells or cubicles, together with downwardly sloped floors in order to continuously move the contents of the drawers, cubicles or cells forwardly for ready access. However, provision of usual wall retainers not only makes cleaning difficult, obscures vision and hinders access (particularly when the quantity of items available is relatively low), but also is unattractive and more expensive to construct.

Accordingly, the present invention is one adapted to provide single and multiple cell, cubicle or container storage and dispensing structures which obviate the difficulties and problems of the old constructions. Additionally, this new principle has permitted the adaptation of the concept to interesting and amusing games for both adults and children.

THE PRIOR ART

Applicant is aware of the following prior art patents related, more or less, to the subject development:

Harlow U.S. Pat. No. 188,512 issued Mar. 20, 1877 for "Post Office Boxes";

Fogarty U.S. Pat. No. 439,646 "Post Office Distributing Case", issued Nov. 4, 1890;

McCaskey U.S. Pat. No. 788,164, issued Apr. 25, 1905 for "Credit Accounting Appliance";

Wise U.S. Pat. No. 3,121,407 "Tool And Parts Holder For Mechanics", issued Feb. 18, 1964;

Liss, et al U.S. Pat. No. 3,212,755, issued Oct. 19, 1965 for "Magnetic Guard Rail"; and Warren U.S. Pat. No. 2,457,421 "Magnetic Retainer", issued Dec. 28, 1948.

BRIEF DESCRIPTION OF THE INVENTION

Basically, the present concept involves the provision of a slanted dispensing floor having one or more magnetic retainers thereon for a cubicle, box or cell used to dispense and store metallic articles having magnetic properties. A first form of the invention comprises an upright chute comprising vertically oriented retaining walls. The floor of the cubicle inclines downwardly from one wall past the other. An opening is provided in the said other wall and a magnetic retainer on the inclined floor before, at or beyond the wall having the opening. Metallic objects dropped down the top of the chute light on the inclined floor and move downwardly thereon until retained by the magnetic retainer. Removal of metallic articles permits other metallic articles to move forwardly into dispensing or grasping position.

A second form of the device comprises the familiar honeycomb cubicle construction familiar in Post Offices around the world. In addition to the honeycomb cubicle construction involving a multiplicity of rectangular (typically) open face cubicles, boxes or containers, the subject development adds the forwardly inclined floor to cause articles positioned on the said floor to tend to move outwardly toward the open ends of the boxes, containers or cubicles. Magnetic retainers are embedded in the floors at the outlet lip or fastened thereover in order to retain the metallic objects in the containers.

Yet another form of the invention involves the provision of a board having a plurality of containers fixed thereto. These may of differing depth, shape and size. They may be arranged in various arrays on the board. They all have in common a forwardly inclined (toward the open faces of the containers) floors and magnetic retainer strips embedded in the floors or fastened thereover. Metallic objects having magnetic properties thrown at these containers may be received therein and retained or not, depending on the skill of the throw.

OBJECTS OF THE INVENTION

A first object of the invention is to provide a number of new, novel storage and dispensing means for metallic objects having magnetic properties.

Another object of the invention is to provide a new form of honeycomb or multiple cubicle box array, which device receives a multiplicity of metallic objects having magnetic properties in each cubicle or container for storage and dispensing. The floors of the cubicles are downwardly inclined toward the open faces and magnetic retainer means are provided to prevent spillage. The handicaps of conventional box or honeycomb arrays with respect to noncontinuous presentation of the objects to be dispensed, the requirement of retainers obscuring the contents of the boxes and difficulties in cleaning are obviated.

Another object of the invention is to provide a single container or box for dispensing metallic objects having magnetic characteristics such as paper clips or thumb tacks, which container continuously receives the devices to be dispensed and offers them on an inclined floor projecting from the box to a greater or lesser degree, the objects being retained by a magnetic strip embedded in the inclined floor or attached thereto.

Another object of the invention is to provide novel game structures involving a multiplicity of containers of differing size, depth, shape and position on a board, while having in common downwardly and forwardly inclined floors with magnetic retainer strips embedded in or attached thereto, objects thrown at the container array being retained or rejected according to the skill of the throw.

Another object of the invention is to provide such improved honeycomb or multiple cubicle arrays of varying type and configuration where floor slope, quantity and position of magnetic material, shape and depth of container, etc., all may be varied to the advantage of the dispensing array, depending upon the products to be dispensed.

Another object of the inveniton is to provide such improvements in containers and multiple containers, as well as multiple container arrays wherein the said containers, etc. are extremely simple, easy and cheap to manufacture, durable, strong and wherein all parts are always readily available for cleaning, restocking and removal of the contents.

Other and further objects of the invention will appear in the course of the following description thereof.

In the drawings, which form a part of the instant specification and are to be read in conjunction therewith, embodiments of the invention are shown and, in the various views, like numerals are employed to indicate like parts.

DESCRIPTION OF THE DRAWINGS

FIG. 4 is an enlarged detail of the upper left hand compartment of the device of FIG. 1.

FIG. 6 is a fragmentary three-quarter perspective view, from the front, of one of the compartments, cubicles or boxes of the device of FIG. 1 showing a variant placing of magnetic strip material therewithin and a lip on the compartment.

FIG. 7 is a fragmentary three-quarter perspective view, from above, of one of the compartments, cubicles or boxes of the device of FIGS. 1–4, inclusive, showing the optional or variational use of a bar placed across the center of the compartment, permitting feed of materials below for disbursement and charging of materials thereabove for storage.

FIG. 8 is a front view of a compartment, cubicle or box of the device of FIGS. 1–4, inclusive (upper left hand corner of FIG. 1) showing a modified form of blocking bar across the front of the cubicles to permit feed from above, disbursement from therebelow and charging of the compartment from above and to the side thereof.

FIG. 11 is a side sectional view through a first form of single chamber dispensing device.

FIG. 18 is a schematic front elevation of a multi-compartment box showing how the compartment arrangement may be varied.

FIGS. 1–4, INCLUSIVE

Figure 1:
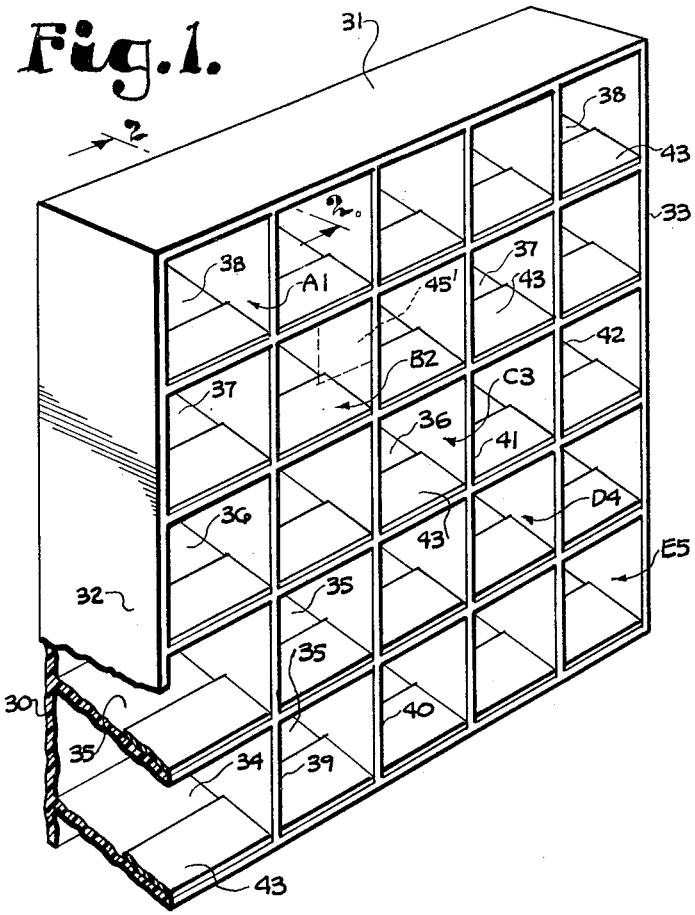
FIG. 1 is a three-quarter perspective view from above of a multiple compartment hardware holding device with a portion of one wall cut away to better illustrate the internal construction (lower left hand corner).

The device of FIGS. 1–4, inclusive is particularly adapted for the storage and dispensing of metallic items having magnetic properties or objects having magnetic properties, per se. Typical examples of such use are involved in the hardware business and in office supply. Additionally, home hobbyists in carpentry, modeling, construction and the like will find such useful. The device is basically a multi-compartment cubicle of box array or construction.

In the device shown, there is provided a square or rectangular vertical rear wall 30 made of wood, plastic or metal. The entire storage element to be described may be conveniently molded of plastic. Normally horizontal top wall 31 and normally vertical side walls 32 and 33 are connected at their rearmost edges to rear wall 30 and define the side and upper boundaries of the device or array. A plurality of downwardly sloped or slanted cubicle or compartment bottom walls 34–38, inclusive are provided which are connected at their rear edges to back wall 30 and at their sidemost edges to side walls 32

In order that specific cubicles may be designated for description purposes, the upper row of cubicles has been designated A, the second row B, the third row, C, the fourth row D and the fifth row (bottom row) E. An individual cubicle has been designated (A1, B2, C3, etc.) in each row to show how the cubicles, compartments or boxes are to be individually called out. It should be understood that the invention contemplates the use of any number of compartments or cubicles in a functioning device. Thus, a single compartment or box with back wall, side walls, top wall (in the single compartment case usually horizontal) and inclined bottom wall also embodies the invention in that it provides a box, compartment or cubicle with an inclined dispensing floor and an magnetic retainer strip. A pair of these on the same level or multiplicity of same, such as E1–5, inclusive, is particularly adaptable to a desk or table to display, store and present various metallic articles to the worker, operator, or user. Two levels of the deck, including 2, 4, 6, 8, 10, etc., cubicles is also feasible, etc. Said otherwise, there may be a multiplicity of vertical decks with one or more sets of lateral, like cubicles or vice versa, specifically, one or more horizontal decks with one or more vertical additions there above. As examples of variance, these may be listed:

(1) A single column of single cubicles (A1, B1, C1, etc);

(2) A single level of horizontal cubicles (E1, E2, E3, etc.);

(3) The entire lower deck (E1–E5, inclusive) topped by the three center cubicles D2–D4, inclusive, the latter topped by only C3. If one is stacking decreasing numbers of cubicles, the construction of the mold, in the case of a plastic molded device, could provide 5, 3, 2, and 1 cubicles stacked one on the other or other variations.

It is necessary that the floors of the cubicles be slanted at an angle of approximately 10° toward the open end and, secondly, there be provided a strip of magnetic tape, or the equivalent, across the floor just inside the opening to keep metallic elements from pouring out of the cubicles or compartments. Specifically, the slanted floors keep the items (screws, nuts, bolts, paper clips, tacks, nails, etc.) moving toward the open faces or ends of the cubicles and the magnetic tape or magnetization of the limited area of the floor at or adjacent the opening retains the items against falling out. As may be seen in FIG. 2, as shown at 43*a* in cubicle B2, the magnetization or magnetic tape may be continued up the side wall to a greater or lesser degree to increase movement control of the devices being stored or dispensing. At 44 in FIG. 2 may be seen a pile of metallic objects or magnetic type objects which pile on the magnetic strip and are retained thereby in this manner. Additional objects may be stored therebehind in a pile of increasing height, retained by those on the strip. An optional retainer wall 45 is shown on the front of cubicle A2. Depending on the size and type or article employed, this may be relatively limited in area or be continued down quite close to the floor 38 and strip or magnetization zone 43. At 45′ in compartment B2 is shown a fragmentary wall of the sort contemplated. Dispensing takes place under the wall and to the side of it, if it is limited. Charging may take place under and to the side of the wall.

The particular device illustrated, in a typical, but not limiting, specific embodiment comprises a 25 cubicle (5×5) array of 3 inch×3 inch×3 inch individual cubicles with approximately ½ inch slope in a 3 inch floor length.

Figure 2:
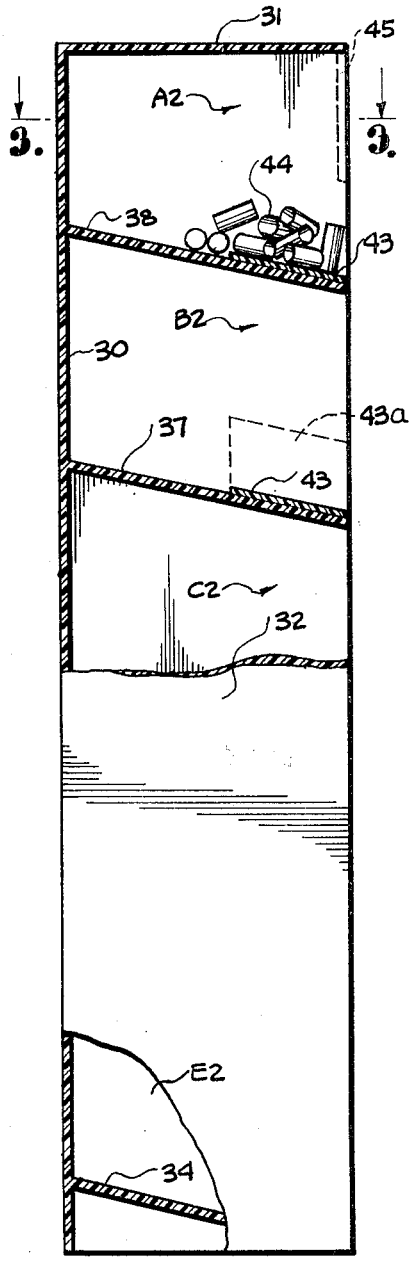
FIG. 2, in the upper portion thereof, is a view taken along the line 2—2 of FIG. 1 in the direction of the arrows. The lower portion of the view of FIG. 2 is a side view of the construction of FIG. 1 taken from the left hand side looking to the right in the view. A portion of the side wall is cut away in the lower left hand corner to better show the construction.

The device itself, as illustrated, with uniform side cubicles and uniform depth thereof, as well as uniform floor slant, is usable as a game. Specifically, that is, metallic objects having magnetic properties or magnetic objects may be tossed at the array from a distance to see if articles will be received or retained in given cubicles. The cubicles themselves can be assigned values with respect to relative difficulty of retention. Thus, the center cubicles are easier to hit and achieve than the peripheral. Of course, the objects tossed toward the array can be of varying levels of magnetization, different shapes, different sizes and the like. Additionally, the presence of one or more partial walls as seen in FIGS. 1 and 2 vary the difficulty of the game.

FIG. 7

FIG. 7 shows a cubicle, arbitrarily C3′ wherein a horizontal central wall or barrier 47 is employed. With respect to a storage and dispensing device, this particular form of barrier permits charging the cubicle either or both over and under the barrier, with dispensing under the barrier. With respect to a game device, this is one form of alternative barrier that could be applied to one or more cubicles or sets of cubicles with respect to difficulty of access to a cubicle or compartment.

FIG. 8

FIG. 8 shows a variation of the blocking constructions seen in FIGS. 1, 2 and 7. In this case, a partial flange or wall 48, extends partly across the front of cubicle A1′ from wall 39′. It permits charging the cubicle or compartment laterally of the wall as well as under and over thereof. Dispensing will be controlled and limited somewhat by the said wall. As a game feature, it is another means of limiting access to a compartment of a given size.

FIG. 6

FIG. 6 shows a variation on the device of FIGS. 1–4, inclusive wherein:

(1) More than one part of the floor of the compartments thereof has magnetic material thereon or is magnetized and (2) A lip is provided exterior of the compartment by extension of the floor outwardly thereof, with some magnetic material or magnetization on the lip.

In this case, assuming compartment D4′, the inclined floor 35′ has an extended, equally inclined projecting lip 35*a*′, the magnetic strip or magnetization 43′ being provided preferably on the entire surface of the lip and, optionally, interior of the compartment to any degree desired. Additionally, a strip 43*b*′ may be provided in the rear portion of the compartment D4′. Yet further, the magnetization or magnetic strip material may be extended up the sides of the compartment as seen at 43*c*′ with respect to the interior magnetization. This latter option is primarily, but not entirely, useful in game application. It hinders forward movement of objects being dispensed. However if such are larger in size, additional control may be thus provided.

From the storage and dispensing stand point, the presence of greater magnetization or quantity of magnetic strip or magnetic material tends to additionally secure a body of material piled in the compartment. However, in such case, the movement of the stored material down the sloped floor is hindered and impeded. An alternative solution to this is the provision of a forward strip 43′ and a rearmost strip 43*b*′ with the floor therebetween clear of magnetic material or magnization. This compromise permits the control of a greater stable base yet movement of materials forwardly in the compartment.

In the case of wood or metal construction, plastic sheathing or plastic paint or the like to minimize friction on the floor may be desirable to aid movement of materials down the slope of the floor. Molded plastic construction may be of high gloss, low friction material to facilitate this. Where an actual magnetic strip is adhered to the floor, the slight ridge at the rear of the strip can also aid in material control.

FIGS. 9 AND 10

Figure 9:
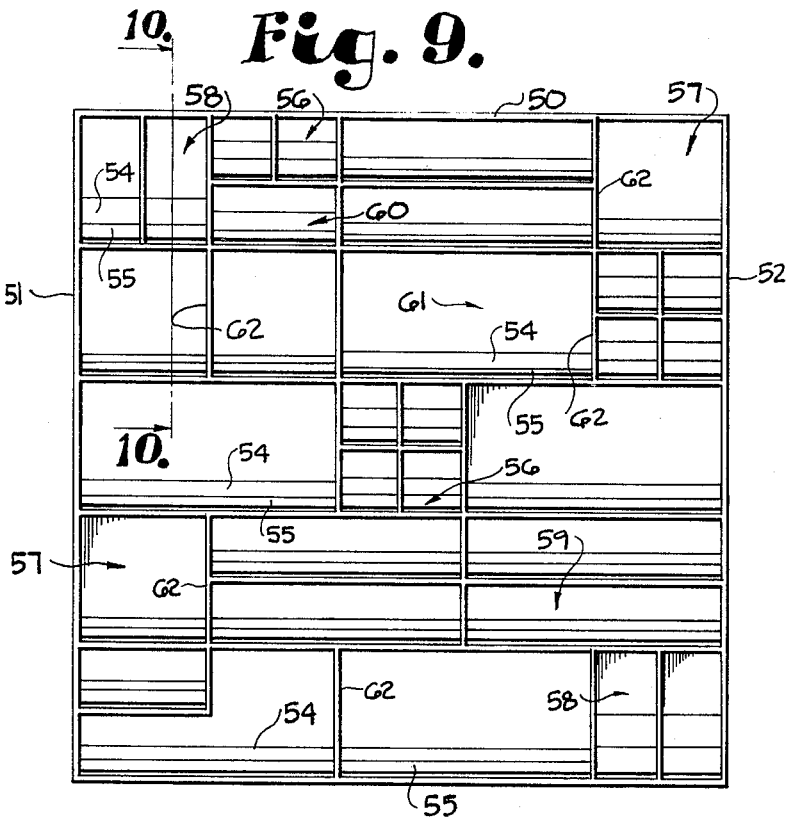
FIG. 9 is a front elevation of a modified form of device comparable to that of FIGS. 1–4, inclusive. Specifically, this figure shows a variant multi-compartment, cubicle or box device having chambers of different size (to receive more varied objects), as well as floors having different slants.
Figure 10:
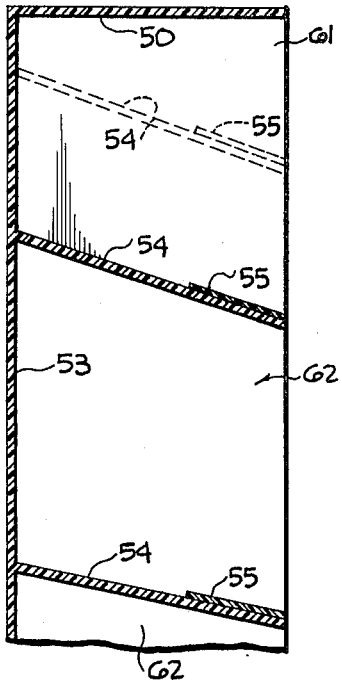
FIG. 10 is a view taken along the line 10—10 of FIG. 9 in the direction of the arrows.

Referring to FIGS. 9 and 10, therein is shown, in front elevation in FIG. 10, a multiple compartment storage and dispensing device or construction having the following features:

(1) The compartments are variously sized with respect to total volume, height, width and configuration; and (2) The smaller compartments are provided with relatively steeper floors.

This sort of construction is particularly adapted to the storage and dispensing of a multiplicity of different types and sizes of metallic materials with magnetic properties or magnetic materials per se. For a hobbyist, utilizing a multiplicity of hand and machine tools, nails, nuts, bolts, tacks and screws can be dispensed from the small cubicles. Larger size nuts, bolts and screws can be dispensed from the intermediate sized cubicles. Drill bits and even tools can be placed within the larger sized compartments. Electrical components are particularly adapted to such storage and dispensing.

In such case, the indispensable elements of the device involve:

(1) The provision of the multiplicity of different sized and shaped compartments, cubicles or boxes with floors, side and top walls;

(2) The provision of downwardly sloped floors to cause materials placed thereon to tend to move forwardly toward the open ends of the cubicles; and (3) The provision of magnetized zones or magnetic materials at the outlets or forward portions of the floors to retain the materials in the compartments.

As described with respect to the device of FIGS. 1-4, inclusive, lips may be provided on one or more cubicles or types of cubicles. Retaining walls, flanges or strips may be provided in one or more types of cubicles. The arrangement of the cubicles with respect to number, size, shape and position may be varied as desired.

Specifically with respect to FIGS. 9 and 10, the device has top wall 50, side walls 51 and 52 and rear wall 53. The floors of each of the cubicles are designated 54 and the magnetic strip or magnetization zone 55. It can be seen that there are seven different types of cubicles in the particular example seen in FIGS. 9 and 10, the different cubicle type numbered 56-61, inclusive. The interior vertical walls of the device of FIGS. 9 and 10 are numbered 62.

FIGS. 11, 12 AND 13

In these figures there are shown three different modifications of single cubicle dispensing containers or boxes. Such may be used on a desk in an office to dispense paper clips or may be placed on a work bench to dispense any particular kind of hardware or the like.

FIG. 11 shows a box rectangular in side and plan view having rear wall 70, top wall 71, side walls 72 and partial front wall 73. The floor 74 is inclined and has magnetized zone or magnetic strip 75 at the forward edge thereof. Wall 71 preferably has circular or rectangular opening 71*a* therein. The lower edge of front wall 73 may be toothed or scalloped as at 73*a*.

Metallic elements charged through opening 71*a* fall onto floor 74 and tend to move forwardly thereon onto magnetic strip or magnetized zone 75. Depending on the type of materials to be dispensed, their size, tendency to roll, etc. the wall 73 may be extended closely toward floor 75 or spaced therefrom. Wall 73 may be partial as in FIG. 7 or FIG. 8. It may also be removed or absent entirely.

Figure 12:
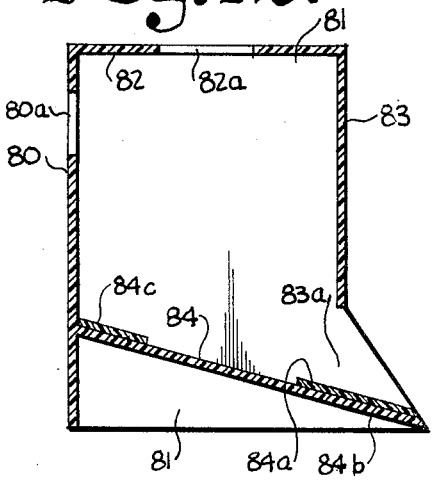
FIG. 12 is a side sectional view through a second form of single chamber dispensing device.

FIG. 12 shows a variant device from that seen in FIG. 11 wherein an extended lip is provided outboard of the front wall of the device and the magnetized zone or magnetic strip is positioned both on the lip and somewhat within the device itself. In this modification, the box provided has rear wall 80, side walls 81, top wall 82, partial front wall 83 and inclined floor 84. Top wall 82 is either not present (this may be the case in FIG. 11, thus see FIG. 13) or has opening 82*a* therein. Inclined floor 84 has magnetized zone or magnetic strip 84*a* thereon, which magnetized area is additionally positioned on outwardly extending (past front wall 83) lip 84*b*. Optionally, and additional magnetized zone or magnetized strip portion 84*c* may be provided rearwardly on floor 84. It should be understood in all cases that the magnetized zones or strips may be extended up the side walls 81 within the box or on extensions 81*a* therewithout, if desired. The boxes in FIGS. 11, 12 and 13 may be of shape other than square or rectangular in horizontal plan, but that shown is optimum.

In FIG. 12, the front wall 83 extends downwardly adjacent to, but spaced upwardly from, floor 84 to provide slot 83*a* therebetween. Thus, the difference between the showing of FIGS. 11 and 12 basically lies in the fact that there is a spatially limited dispensing zone outside of the box, which permits the enlargement of slot 83*a*. Materials inserted through opening 82*a* fall to floor 84 and are retained by magnetic zone 84*c* or move forward on floor portion 84 to the control zone (above strip 84*a* and under wall 83, also between extensions 81*a* of the side walls 18). Front wall 83 may be omitted to a greater or lesser extent, if desired.

As an alternative, an opening 80*a* may be provided in the upper portion of rear wall 80 for charging of materials to the container. In such case opening 82*a* may or may not be present. Such an opening could be provided in the rear or side walls of the structures of FIGS. 11 and 13.

Figure 13:
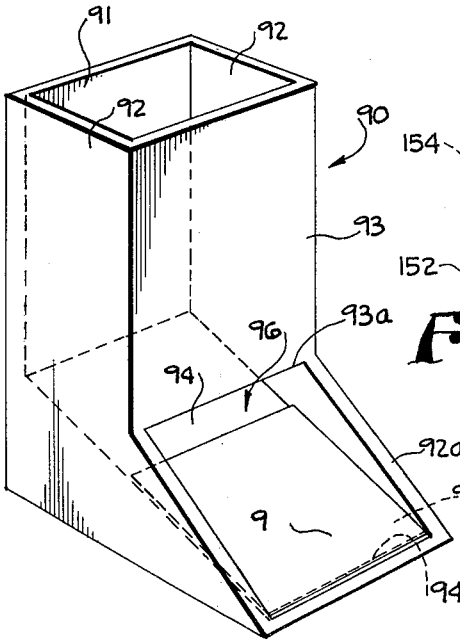
FIG. 13 is a three quarter perspective view from above of a third form of single chamber dispensing box or device.

In FIG. 13 there is seen a logical extension or variation of the devices of FIGS. 9 and 12. In this construction, vertically oriented box 90 has rear wall 91, side walls 92 and front wall 93. Floor 94 is inclined and has an extending lip portion 94*a* continuous therewith. Side walls 92 have extensions 92*a* past front wall 93. Magnetized zone or magnetic plate or strip 95 is provided on the lip portion 94*a*. This may be extended up the inboard sides of extension 92*a* and somewhat into the interior of the box past wall 93 if desired. A slot or opening 96 is provided between floor 94 and the lower edge of wall 93 at 93*a*.

Any magnetic type materials or items dropped in the open upper end of box 90 fall onto the inclined floor portion 94 and move downwardly and outwardly onto lip 94*a*. The magnetized zone or magnetic material 95 restricts the movement of such materials out past slot 96. As such are removed from the lip in usage, additional materials can move forwardly for access and dispensation. Minor shaking or tilting the box in each of the cases of FIGS. 11, 12 and 13 will bring access of materials as required. The width of the slot and inclination of the floor, as well as the extent of the lip and magnetic material may relate to the type of objects being dispensed. Thus, paper clips and ball bearings would have different mobility characteristics and slot access requirements. If floor 94 is relatively steep, a ridge 94*b* for final retention may be provided at the end of the lip 94*a* if desired. Round, rollable objects are thus terminally retained.

A lid, not seen, may be provided for the box of FIG. 13 to minimize dust collection.

FIGS. 14–17, INCLUSIVE

Figure 14:
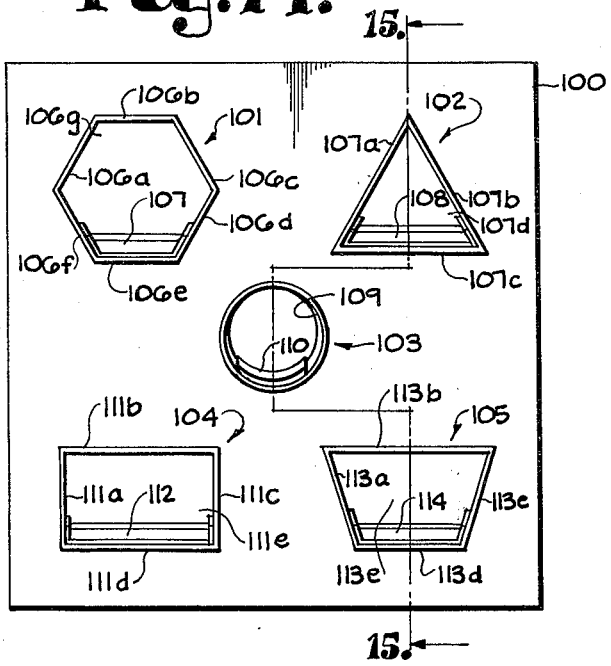
FIG. 14 is a front elevation of a game device wherein boxes, compartments, cubicles or containers of different geometric shapes are fixed to a supporting wall or board to receive metallic objects thrown thereat and retain or reject same.
Figure 15:
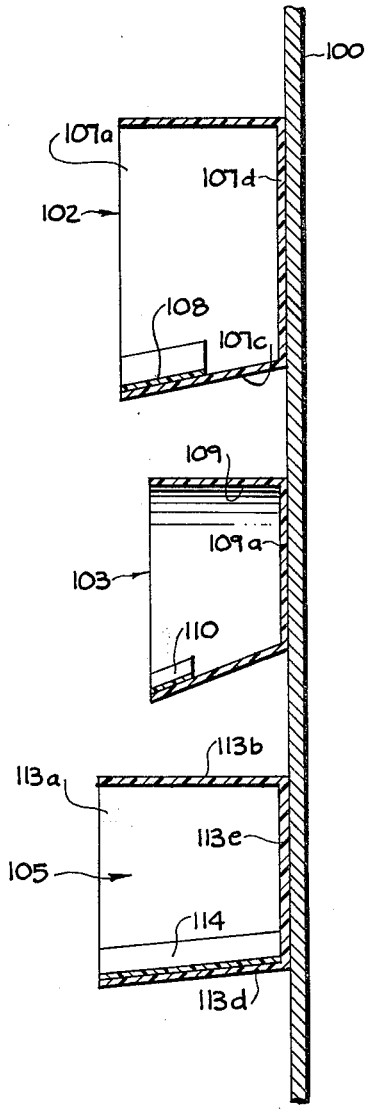
FIG. 15 is a view taken along the line 15—15 of FIG. 14 in the direction of the arrows.

Turning first to FIGS. 14 and 15, therein is shown a variation or modification of the subject invention particularly adapted for game use. In this particular form, in these two figures, containers, cubicles or cells of differing geometric shape are fixed or removably fixed to a board to provide throwing targets for magnetic objects or metal objects with magnetic properties. The various cells have the subject inclined floors with magnetization or magnetic strips at the outlet edges. The cells may differ in depth, size, geometric shape, quantity of magnetic material, positioning of the magnetic material and slope of floor. They also vary in position on the backing board which may be of any desired shape.

Specifically, in the views, there is seen a backing board 100 which may be of wood, plastic, metal or the like. On it are fixed (in FIGS. 14 and 15) a plurality of containers or cells generally designated 101 (hexagonal), 102 (triangular), 103 (circular), 104 (rectangular) and 105 (inverted frusto-conical). Clearly, this array does not exhaust the geometric possibilities which may be any combination of straight and curved sides or complications desired. For children, well known geometrical figures may well be employed and the names thereof placed on the board, as well, if desired, for learning purposes.

In the specific case shown, the hexagonal container 101 has six defining walls 106*a–f,* inclusive. The bottom wall 106*e* is downwardly slanted and has magnetic strip or magnetization zone 107 thereon. Likewise, triangular cell or container 102 has defining walls 107*a–c,* inclusive, with the downwardly inclined bottom wall 107*c* having magnetic strip or magnetization zone 108 at the outlet thereof. Cylindrical or semi-cylindrical container or cup 103 has defining wall 109 with magnetization zone or magnetic strip 110 associated therewith. In the view of FIG. 15, it may be seen that the triangular cup 102 is of greater depth than the circular cup 103. Cup 103 has a greater slant to the bottom wall portion thereof than that of wall 107*c* of member 102.

A rectangular container 104 has walls 111*a–d,* inclusive, the latter being the downwardly inclined floor. In this case the magnetic strip or magnetization at 112 is shown covering most of the entire floor zone. Cup or container 105 has walls 113*a–d,* inclusive, the latter being the downwardly inclined floor. Magnetization zone or magnetic strip 114 is here shown overlying most of the entire floor and part of the lower side walls. This cell is also seen in FIG. 15 where it is shown as having greater depth than containers 102 and 103 and the least slope of the three.

The rear walls 106*g,* 107*d,* 111*e* and 113*e* have not been previously called out. However, if necessary for connection purposes, or if desired for impact protection, they may be provided as seen in FIGS. 14 and 15.

Figure 16:
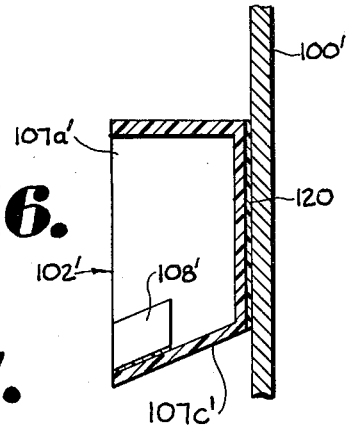
FIG. 16 is a fragmentary section of a variation in structure of the device of FIGS. 14 and 15.

The presence of a rear wall is desirable in the modification of FIG. 16, wherein is shown a variation of the container devices of FIGS. 14 and 15 which is movable about or removable from the back board 100. In this case, the back board 100′ is of metal or magnetic material. The container 102′ (parts identical are numbered the same but primed) has on the back thereof magnetic materials or metal having magnetic properties as at 120. In this case backing wall 100′ and container backing 120 are magnetized between them, so that the attraction will hold the container on the backing, permit moving of it around on the backing or removal thereof from the backing. If the container itself is of magnetic material and the backing of metal, then no additional layer or sheeting is required. The reverse is true. In such case, the containers of FIGS. 14 and 15 could be arranged as desired on the backing. Additionally, other containers of same or different shape could be substituted or added, etc.

Figure 17:
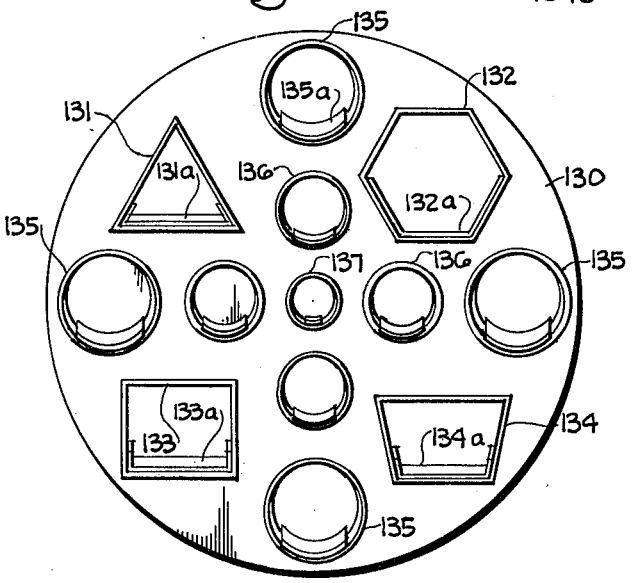
FIG. 17 is a front elevation of a modified form of game device where, in addition to geometric shapes, different sizes of cubicle, container or compartment and floor slopes are employed.

FIG. 17 shows a variation of the construction discussed with respect to FIGS. 14–16, inclusive. Therein is shown a circular backing or backing board 130 having containers 131–134, inclusive, of respective triangular, hexagonal, rectangular and frusto-conical form provided. All of the floors thereof are inclined forwardly, save for that of the hexagon. Magnetic strip materials or magnetization zones 13*a*–134*a* are provided on greater or lesser portions of the floor, preferably near the outlet edges.

Additionally, there are provided a plurality of semi-cylindrical containers or cups 135 (large and outboard), 136 (intermediate size and inboard of the larger circles) and 137 (central and smallest). All have magnetization zones or magnetic strips 135*a,* 136*a* and 137*a,* respectively, of greater or lesser extent and depth and width therewithin. Here the larger outboard cups are shown as having a greater slant on the lower floor portions, such decreasing inwardly with size. The size, depth and extend of the magnetization zones and magnetic strips can be increased inwardly to counteract the slope change, if desired. If the containers of this figure were of the movable sort described with respect to FIG. 16, such could be arranged as desired on the board 130.

In use of the games of FIGS. 14–17, inclusive, and the previously described constructions as games, clearly, the projectiles to be thrown at the containers may vary considerably. Paper clips may be used in all cases. Hardware items of any sort may be employed. Ball bearings in the round or with one flattened side may be employed. Flat metal discs are also useful. Scoring may be based on relative difficulties of size, position, floor slope and the like.

Thus it may be seen that games of varied construction and difficulty of considerable interest are supplied by the subject improvement. Such are useful for motor and intellectual development of children and amusement of adults.

The provision of isolated cells of like or different size on a backing board as in FIGS. 14 and 15 may be adapted to the storage and dispensing use of the devices of FIGS. 1–13 inclusive. In such case the cells may be of any desired size, shape and depth. Sloped floors with magnetized zones or magnetic retainers at the outlet edges would be employed as previously described. The actual illustrated array of cells or chambers of FIGS. 14 and 15 might be employed by a user or, alternatively, several cells of one shape, several sets of cells each of one shape, all cells of one shape or the like. Provision of movable and removable cells as seen and described in FIG. 16 would increase versatility and usefulness. The array of FIG. 17 used for storage could exemplify another specific example of versatility in size, shape, slope, board position, depth and the like for separate cells on a given backing board.

FIG. 18

FIG. 18 is a very schematic representation of a honeycomb cubicle construction where the cubicles are stacked upwardly in a decreasing number as previously noted as a possibility. It is assumed that the construction of the cubicles is that of FIGS. 1–4, inclusive with the cells or cubicles of equal size, having downwardly slanted floors with magnetic zones at the outlet front openings of the cells as described. The separate rows of cubicles are designated 140–143, inclusive, the lowermost row having four cubicles, the next three, the next two and the top row being a single cubicle.

FIG. 19

Figure 5:
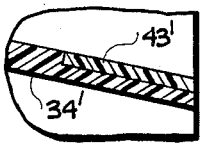
FIG. 5 is a fragmentary cross-sectional view of the forward end of one of the floors of the compartments in the device of FIGS. 1–4, inclusive, the magnetic insert, however, being shown in a modified form embedded in the end of the floor itself.
Figure 3:
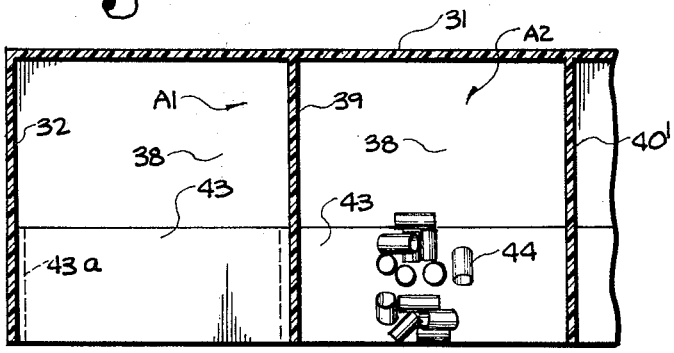
FIG. 3 is a view taken along the line 3—3 of FIG. 2 in the direction of the arrow.
Figure 19:
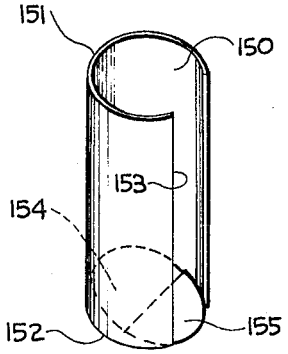
FIG. 19 is a single chamber device (shown in three-quarter perspective from above) having an open top and front wall for dispensing objects like paper clips.

FIG. 19 represents a variation of construction in the single cell dispensing construction of FIGS. 11–13, inclusive. In this construction, the single arcuate wall 150 is provided having normally horizontal upper edge 151 and normally horizontal lower edge 152. Wall 150 has an opening 153 in one portion thereof. This opening extends the entire height of the wall in the construction seen. An angled or tilted flat floor 154 is provided adjacent the lower edge of arcuate wall 150 affixed thereto. Magnetic patch or strip 155, which may be embedded as in FIG. 5, is provided on the lower portion of the floor interior of opening 153.

In operation, paper clips, thumb tacks, brads or other like metallic accessories for an office, or hardware for a hobbyist or the like, is placed in the container of FIG. 19 either through opening 153 or in the open top of wall 150. Hardware placed on the floor 154 will tend to move downwardly across the slope until encountering the magnetic portion 155. At the point it piles up and retains additional magnetic type material or magnetizable hardware within the container. The user or operator takes the individual items from the magnetized zone as required and automatic feed is provided by the slope of the floor. The floor slope is, preferably, substantially 10° or greater.

With respect to the construction of FIGS. 11–13 and 19, in all cases, in charging, the boxes, cells or containers may be manipulated in position so as to charge through the discharge opening, in addition to the top opening. That is, they may be laid or tilted nearly to one side for charging, the return to vertical moving the hardware across the preferably normally slick floor until impeded by the magnetization zones. The nonmagnetized floor zones are preferably low friction, that is, either painted with glossy paint in the case of wood or slick plastic, nonferrous metal or the like. While the slope of the floor is preferably sufficient to move the hardware items to the magnetic impedance zone or zones, the combination of such slopes and a hard, monolithic, relatively slick floor may minimize the slope required. In the latter case, about ten degrees of slope is generally required.

As previously mentioned, each of the modifications of FIGS. 11, 12 and 13 may have the front wall thereof removed in the manner of FIG. 19, as desired. In such case, the quantity of materials or hardware which may be stored in the cell or cubicle is limited by that which may be retained by the magnetic strip itself. When the front wall is present, with or without outward extensions and side walls as seen in FIGS. 12 and 13, the combination of the wall and the restriction of the dispenser opening permits the retention of a greater or a lesser amount of hardware to be dispensed from the cell. Partial front walls may be employed. A removable band of adhesive material applied across the opening of the device of FIG. 19 spaced upwardly from the magnetization zone 155 will provide additional retention, if desired.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A device for storing and dispensing objects with magnetic properties comprising, in combination:

an open face, rectangular, hollow cubicle having three normally vertical, rectangular wall panels joined one to another, at one vertical edge thereof at right angles to one another, to provide two side and one rear walls thereof, a floor panel of rectangular form connected at three side edges thereof to the three wall panels, said floor panel normally uniformly inclined from the horizontal at a substantial yet limited angle, with its raised edge connected to the rear wall above the lower edge thereof and its two side edges to the side wall panel lower edges, the forward and lowermost surface portion of the floor magnetized to retain objects with magnetic properties thereon, a portion of said floor rearward of said magnetized portion being not magnetized, the portion of the floor which is not magnetized also having a low surface frictional resistance, whereby objects placed thereon will tend to continuously move from inboard next to the rear wall outwardly on said floor to the magnetized zone where they will be held from further movement by magnetic force.

2. A device as in claim 1, including a retaining member blocking a portion of the open side wall of the cubicle above the magnetized portion of said floor.

3. A device as in claim 1 including a normally substantially horizontal top wall comprising a rectangular panel connected at three side edges thereof to the top edges of the side wall panels.

4. A game device comprising in combination:

a backing board adapted to be supported in normally vertical position, said board having front and back faces, a plurality of open faced compartment members secured to the front face of said board, each compartment member made up of at least one wall member providing a substantially flat floor and side walls rising upwardly from the lateral limits of each such floor, thereby providing a plurality of separate, floored receptacles extending from the said one face of said backing board, the floor of each such compartment uniformly inclined downwardly at a substantial yet limited angle normal to the backing board and extending outwardly away therefrom with the outer upper surface of at least some of said floors magnetized to retain magnetic objects on said floor, said some floors each also being provided with a portion thereof which is not magnetized, the portions of the partially magnetized compartment floors which are not magnetized also having a low surface frictional resistance, whereby objects placed thereon will tend to continuously move from inboard adjacent the backing board outwardly on each said floor to the magnetized zones where they will be held from further movement by magnetic force.

5. A device as in claim 4 wherein the compartments are separate from one another and spaced apart on the backing board.

6. A device as in claim 4 wherein the said compartments are next and adjacent to one another.

7. A device as in claim 4 wherein each compartment is defined by a single continuous wall providing a floor, sidewalls and a top, said wall secured at one end thereof to the backing board said one face.

8. A device as in claim 4 wherein each compartment member is separate from the others and at least one of said compartment members is removably and movably secured to said backing board face.

9. A game device comprising, in combination:

a backing board adapted to be supported in normally vertical position, said board having front and back faces, a plurality of open faced compartment members secured to one face of said board, each made up of at least one wall member providing a substantially flat floor and side walls rising upwardly from the lateral limits of each such floor, thereby providing a plurality of separate, floored receptacles extending from the said one face of said backing board, the floor of each such compartment inclined somewhat downwardly from an angle normal to the backing board and extending outwardly away therefrom with the outer upper surface of at least one of said floors magnetized to retain magnetic objects on said floor, the slopes of the floors of two compartment members varying, one from the other.

10. A device as in claim 4 wherein two of the compartment members are of different size from one another.

11. A device as in claim 4 wherein two of the compartment members are of different shape, one from the other.

12. A device as in claim 4 wherein two compartment members are of different size and shapes, one from the other.

13. A game device comprising, in combination:

a backing board adapted to be supported in normally vertical position, said board having front and back faces, a plurality of open faced compartment members secured to one face of said board, each made up of at least one wall member providing a substantially flat floor and side walls rising upwardly from the lateral limits of each such floor, thereby providing a plurality of separate, floored receptacles extending from the said one face of said backing board, the floor of each such compartment inclined somewhat downwardly from an angle normal to the backing board and extending outwardly away therefrom with the outer upper surface of at least one of said floors magnetized to retain magnetic objects on said floor, at least some of the compartments being of different size, one from the other, at least some of the compartments being of different shape, one from the other, and at least some of the floors thereof being of different slopes, one from the other.

14. A game device comprising, in combination:

a backing board adapted to be supported in normally vertical position, said board having front and back faces, a plurality of open faced compartment members secured to one face of said board, each made up of at least one wall member providing a substantially flat floor and side walls rising upwardly from the lateral limits of each such floor, thereby providing a plurality of separate, floored receptacles extending from the said one face of said backing board, the floor of each such compartment inclined somewhat downwardly from an angle normal to the backing board and extending outwardly away therefrom with the outer upper surface of at least one of said floors magnetized to retain magnetic objects on said floor, at least some of the floor being of different slope, one from the other and the quantity of magnetization thereon varies.

15. A device as in claim 4 wherein the depth of at least one of the compartments varies from the depth of another compartment.

16. A device for receiving, holding and dispensing objects with magnetic properties therefrom, comprising, in combination:

(1) a backing board adapted to be supported in a normally vertical position, (2) said board having a back face on one side thereof and a front face on the other side, (3) at least one open faced compartment member secured to the front face of said board, said member made up of at least one wall member extending outwardly from the front face of said backing board and providing at least a lower floor portion and sidewall portions rising upwardly from the lateral limits of said floor, thereby providing a floored receptacle extending outwardly from the front face of the backing board, (4) the floor of said compartment member uniformly including downwardly at a substantial yet limited angle from the backing board outwardly away therefrom, with the outer, upper surface of said floor magnetized to retain magnetic objects thereon, said floor being provided with a portion rearwardly of said magnetized surface which is not magnetized, the portion of said compartment member floor which is not magnetized also having a low surface frictional resistance, whereby objects placed thereon will tend to continuously move from inboard outwardly on said floor to the magnetized zone where they will be held from further movement by magnetic force.

17. A device as in claim 16 wherein the compartment is defined by a single, continuous wall providing a floor, side walls and a top wall for said compartment, said single continuous wall secured at one end to the baseboard front face.

18. A device as in claim 16 wherein the said compartment is removably and movably secured to said baseboard front face.

19. A device as in claim 16 wherein the compartment member itself has a backing wall which is secured to the front face of the backing board.

20. A device as in claim 19 wherein the back face of the backing wall of the compartment member is magnetized and the front face of the backing board, in at least a portion thereof, is also magnetic for removability and movability of said compartment on the front face of said backing board.

21. A honeycomb device for storing and dispensing magnetic type articles comprisong:

(1) a normally vertical backing member having front and rear faces, (2) a plurality of partition members fixed to the front face of the backing member in such manner as to provide a multiplicity of compartments thereon having open outboard ends thereto, (3) each compartment formed by said partition members and having a floor, side walls and a top wall defining each said compartment, (4) the floor of each compartment uniformly inclined downwardly at a substantial yet limited angle from the horizontal as it extends outwardly from the backing member, at least the outboard top surfaces of a plurality of said floors magnetized to retain magnetic elements thereon, portions of said floors inwardly of said outboard top surfaces being not magnetized, the portions of said magnetized compartment floors which are not magnetized also having a low surface frictional resistance, whereby objects placed thereon will tend to continuously move from inboard outwardly on said floor to the magnetized zones where they will be held from further movement by magnetic force.

22. A device as in claim 21 wherein the compartments are rectangular in form viewed from the front thereof.

23. A device as in claim 21 wherein the normally vertical backing member is flat.

24. A device as in claim 21 wherein all of the compartments are substantially the same size and shape and the slope of the floors therein are substantially the same.

25. A honeycomb device for storing and dispensing magnetic type articles comprising:

(1) a normally vertical backing member having front and rear faces, (2) a plurality of partition members fixed to the front face of the backing member in such manner as to provide a multiplicity of compartments thereon having open outboard ends thereto, (3) each compartment formed by said partition members and having a floor, side walls and a top wall defining each said compartment, (4) the floor of each compartment inclined downwardly from the horizontal as it extends outwardly from the backing member whereby an object placed thereon will tend to move from inboard outwardly on said floor.

at least the outboard top surfaces of a plurality of said floors magnetized to retain magnetic elements thereon, the compartments differing from one another in size and the slope of the larger compartment floors differing from the slope of the smaller compartment floors.

26. A honeycomb device for storing and dispensing magnetic type articles comprising:

(1) a normally vertical backing member having front and rear faces, (2) a plurality of partition members fixed to the front face of the backing member in such manner as to provide a multiplicity of compartments thereon having open outboard ends thereto, (3) each compartment formed by said partition members and having a floor, side walls and a top wall defining each said compartment, (4) the floor of each compartment inclined downwardly from the horizontal as it extends outwardly from the backing member whereby an object placed thereon will tend to move from inboard outwardly on said floor, at least the outboard top surfaces of a plurality of said floors magnetized to retain magnetic elements thereon, said floors including portions which are not magnetized, the portions of the floors which are not magnetized having less frictional resistance than the magnetized portions.

27. A device for storing and dispensing objects with magnetic properties comprising in combination:

a backing board adapted to be supported in normally vertical position, said board having front and back faces, a plurality of open faced compartment members secured to one face of said board, each made up of at least one wall member providing a substantially flat floor and side walls rising upwardly from the lateral limits of each such floor, thereby providing plurality of individual, floored receptacles extending outwardly from the said one face of said backing board, the floor of each such compartment uniformly inclined at a substantial yet limited angle downwardly from normal to the backing board and extending outwardly away therefrom, with the outermost upper surface of each said floor magnetized to retain magnetic objects on said floor, each said floor being provided with a portion rearwardly of said outermost upper surface which is not magnetized, the portions of the compartment floors which which are not magnetized also having a low surface frictional resistance, whereby objects placed thereon will tend to continuously move from inboard outwardly on each said floor to the magnetized zones where they will be held from further movement by magnetic force.

28. A device as in claim 27 wherein the compartments are separate from one another and spaced apart on the backing board.

29. A device as in claim 27 wherein a plurality of said compartments are defined each by a single, continuous wall providing a floor, side walls and a top, said walls secured at one end thereof to the backing board said one face.

30. A device as in claim 27 wherein a plurality of said compartment members are removably and movably secured to the backing board said one face.

31. A device as in claim 27 wherein the slope of the floors of two compartment members vary, one from the other.

32. A device as in claim 27 wherein two of the compartment members are of different sizes one from another.

33. A device as in claim 27 wherein two of the compartment members are of different shape, one from the other.

* * * * *